United States Patent [19]

Clark et al.

[11] 3,962,115

[45] June 8, 1976

[54] TREATMENT OF OPTICAL BRIGHTENING AGENTS

[75] Inventors: David Ronald Clark; Thomas Gerald Hyde, both of Sale, England; Robert Erik Brauchbar, Aesch, Switzerland

[73] Assignee: Ciba-Geigy AG, Basel, Switzerland

[22] Filed: Oct. 30, 1973

[21] Appl. No.: 411,169

Related U.S. Application Data

[63] Continuation of Ser. No. 128,198, March 25, 1971, abandoned.

[30] Foreign Application Priority Data

July 9, 1970 United Kingdom..... 33419/70

[52] U.S. Cl...... 252/301.23; 252/311; 252/363.5; 252/543

[51] Int. Cl.[2]..... C09K 11/06

[58] Field of Search..... 252/311, 890 B, 301.2 W, 252/301.3 W, 363.5, 543

[56] References Cited

UNITED STATES PATENTS

| | | | |
|---|---|---|---|
| 2,384,564 | 9/1945 | Roseman et al. | 252/317 |
| 3,177,207 | 4/1965 | Siegel et al. | 260/240 |
| 3,595,801 | 7/1971 | Rosch et al. | 252/301.2 W |
| 3,630,944 | 12/1971 | Obkawa et al. | 252/301.3 W |
| 3,682,946 | 8/1972 | Liechti | 252/301.2 W |

*Primary Examiner*—Herbert B. Guynn
*Attorney, Agent, or Firm*—Wenderoth, Lind & Ponack

[57] ABSTRACT

A thixotropic slurry is prepared comprising a compound having the formula

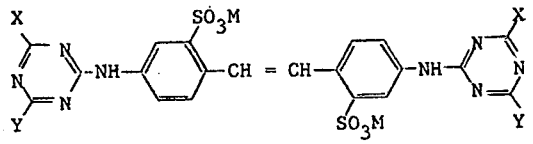

wherein X and Y may be the same or different and each represents a mono- or di-substituted amino or alkoxy group and M represents an alkali metal or hydrogen, by mixing the wet filter cake obtained during the preparation of this compound with a dispersing agent such that the resulting slurry has a Brookfield viscosity from 200 to 10,000 centipoises at 6 r.p.m. A detergent composition is prepared by adding the above obtained slurry to a detergent and mixing.

23 Claims, No Drawings

TREATMENT OF OPTICAL BRIGHTENING AGENTS

This is a continuation of application Ser. No. 128,198, filed Mar. 25, 1971, now abandoned.

DESCRIPTION OF THE INVENTION

The present invention relates to a method of preparing slurries of triazine type optical brightening agents.

Triazine type optical brightening agents are often used in the form of a dry powder which is prepared from the wet filter-cake which, after being transferred to trays, is dried in ovens for several hours. Due to difficulties in handling the dry powder and because of the dust hazard it would be advantageous to use the brightening agent in the form of an aqueous slurry. Indeed, attempts have been made to slurry the dry powder and also the wet filter-cake by mixing with water, but these have not been successful in that the slurry obtained is not homogeneous, tends to settle quite quickly and the product brightening and the cold water dyeing properties are affected. There are also difficulties involved in slurrying a dry powder.

We have found, surprisingly, that homogeneous, thixotropic slurries of such brightening agents can be prepared by mixing their wet flter-cakes with a dispersing agent. Such slurries do not settle appreciably during static storage, since they set to a gel-like form and no appreciable settling takes place during static storage for long periods, for instance 12 weeks. In addition to the good settling properties the slurries have viscosity characteristics which make them much easier to handle than the powdered form since they can be discharged from storage under gravity or by pumping, and the dust hazard which is presented by the powdered form is eliminated. Moreover there is no deterioration in their product brightening or cold water dyeing properties when incorporated in a spray-dried detergent.

According to the present invention there is provided a process in which a slurry is prepared containing from 15% to 60% by weight based on the total weight of the slurry of a compound having the formula:

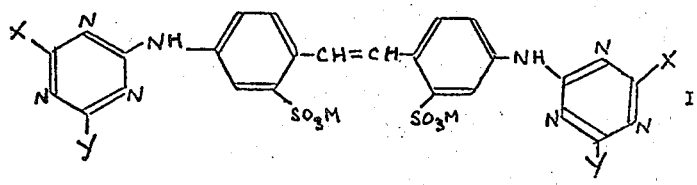

I wherein X and Y may be the same or different and each represents a mono- or di-substituted amino or alkoxy group and M represents hydrogen, an alkali metal or an amine salt, by mixing the wet filter-cake obtained during the preparation of this compound with a dispersing agent, such that the resultant slurry is thixotropic and will not settle out appreciably on static storage and will have a Brookfield viscosity from 200 to 10,000 centipoises at 6 revolutions per minute and up to 2000 centipoises at 60 revolutions per minute.

Thus, X and Y can be phenylamino, phenylamino mono- or di-substituted by alkyl radicals of 1 or 2 carbon atoms, morpholino, alkylamino of 1 – 4 carbon atoms, alkylamino of 1 – 4 carbon atoms substituted by hydroxy radicals or alkoxy of 1 – 4 carbon atoms. For example, X and Y can be phenylamino, morpholino, alkylamino of 1 – 4 carbon atoms or alkylamino of 1 – 4 carbon atoms substituted by hydroxy radicals. More particularly, X and Y can be phenylamino, morpholino or N-methyl-N-ethanol amino. Even more particularly, X and Y can be morpholino or N-methyl-N-ethanol amino.

If the concentration of the compound of formula I present in the slurry is too high, the slurry may become dilatant, and this leads to difficulties in pumping the slurry. This dilatancy can be overcome by diluting the slurry with water or aqueous electrolyte. However, if the concentration is too low, poor settling stability is obtained.

The desired proportion of compound having the formula I which is present in the slurry may be obtained either by adding water, aqueous electrolyte, slurry or further dry powder to the wet filter-cake. This may be added with the dispersing agent, or may be added before or after the addition of the dispersing agent. The proportion of the compound of formula I which is present in the slurry is advantageously from 20% to 60%, but is preferably from 20% to 40% by weight based on the weight of slurry.

The slurry is then mixed with the dispersing agent until it is homogeneous. The mixing may be carried out for instance in a homogeniser.

The thixotropic slurries under static storage conditions set to a gel-like form, which can easily be mobilized by stirring. This reduces the viscosity so that it is possible to discharge the slurry by pumping or running out under gravity.

The dispersing agent may be an anionic, cationic or non-ionic surface active agent. Examples of suitable dispersing agents are as follows:

- The sodium salt of the condensation product of naphthalene sulphonic acid and formaldehyde. The sodium salt of dibutyl naphthalene sulphonic acid.
- The condensation product of capryl wax and ethylene oxide.
- A mixture of cyclohexanol and stearamide. The sodium salt of a sulphonated oil. Bis(2-hydroxyethyl) tallow amine oxide. Mono fatty or resin acid esters of polyoxyethylene glycols.
- Amphoteric N-Coco-$\beta$-amino butyric acid.
- A polymer of mixed propylene/ethylene oxides. Organic crystalline water soluble wax or the semi sodium salt.
- Non-ionic long chain polyoxyethylene ether condensates.

The amount of dispersing agent that is added to the wet filter cake may conveniently be from 0.1 to 5% by weight based on the weight of the wet filter-cake, and preferably the proportion of dispersing agent is within the range of from 0.5% to 2% by weight based on the weight of the wet filter-cake.

If desired, a gelling agent may also be added to the slurry. Examples of gelling agents are carboxy vinyl polymers, highly beneficiated magnesium silicate, magnesium montmorillonite, or pure silicic acid in fine particle form. The amount of gelling agent added may vary but is usually within the range of from 0.1% to 2% by weight based on the weight of wet filter-cake, preferably from 0.1 to 1%.

If desired an electrolyte may be added to the slurry. The electrolyte may be sodium chloride, sodium sulphate, sodium carbonate or the corresponding potassium salts. The amount of electrolyte is at least 4% by weight and may be from 4% to 25% by weight, based on the total weight of slurry, preferably from 5% to 20%.

Products in which the presence of electrolyte is particularly advantageous are the crystalline forms of the products having the formulae:

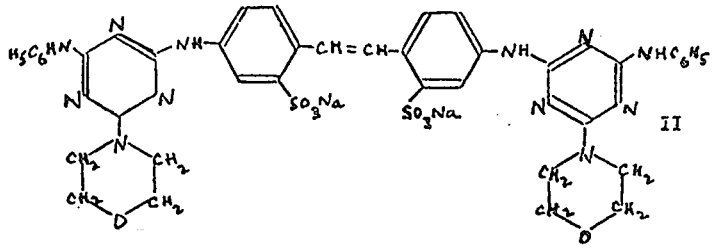

II and

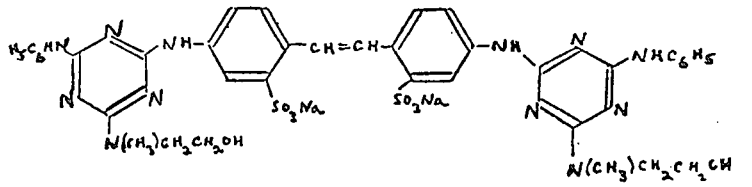

III

When electrolyte is added to a slurry of the crystalline form of a compound having the formula II or III, the colour of a spray-dried detergent in which the slurry is incorporated is enhanced.

Furthermore, the cold water dyeing properties may be improved by subjecting the slurry to a grinding treatment. The cold water dyeing properties depend on the surface area of the particles and the particle size can be controlled during the preparation of the compound or by grinding the slurry.

The grinding treatment has been found to be valuable for the product having the formula II and good cold water dyeing properties are obtained when a major proportion of the particles in the slurry have a size from 5 to 20 microns, preferably from 5 to 10 microns.

The viscosity of the slurry is linked to the concentration and the surface area of the particles. At 6 revolutions per minute the Brookfield viscosity is preferably from 300 to 5000 centipoises and at 60 revolutions per minute the viscosity is preferably from 50 to 1000 centipoises.

The homogeneous slurry thus produced may, if desired, be diluted or concentrated according to requirements.

The production of an aqueous slurry according to the present invention has the advantage over the production of the dry powder in that the compound of formula I is produced in a form suitable for immediate use by a quicker process involving fewer stages and there is correspondingly less product lost during its preparation. Furthermore, the slurries of the present invention may be kept for several weeks, for instance 12 weeks or more, without any appreciable settling during storage or deterioration of properties when incorporated in a detergent.

The slurry may afterwards be incorporated into a detergent, for instance by running the required amount of slurry from a tank into a mixer containing a slurry of the detergent. The present invention also provides a detergent composition prepared by adding a slurry prepared as hereinbefore described to a detergent and mixing.

The following Examples further illustrate the present invention. Parts by weight bear the same relation to parts by volume as do kilograms to liters. Parts and percentages are expressed by weight.

EXAMPLE 1

0.75 parts of the condensation product of naphthalene sulphonic acid and formaldehyde was added to a wet filter cake comprising 66.5 parts water, 0.75 parts sodium chloride and 32.0 parts of the amorphous compound having the formula III.

This was first hand mixed, then homogenised with a Silverson mixer. The Brookfield viscosity range of the slurry was 3000 centipoises at 6 r.p.m. and 510 centipoises at 60 r.p.m.

Table I lists the settling stability of the slurry over a 12 week period. Examination of this table shows that there was no appreciable settling over the period, and at the end of the period the slurry was stirred and then easily discharged from the container under gravity or by pumping.

Table I

Slurry settling stability in one ton container.

| Time elapsed weeks | SOLIDS CONTENT % Top | Middle | Bottom |
|---|---|---|---|
| 0 | 33.2 | 33.4 | 33.3 |
| 4 | 31.2 | 35.4 | 33.0 |
| 8 | 32.2 | 32.6 | 33.5 |
| 12 | 31.3 | 33.6 | 34.0 |

This slurry has the same application properties as the normal dry powdered material with regard to whitening at various temperatures and product brightening.

EXAMPLE 2

0.4 parts of the sodium salt of the condensation product of naphthalene sulphonic acid and 0.5 parts magnesium silicate, sold under the trade name "Benaquee", was added to a wet filter-cake comprising 64.1 parts of water and 35.0 parts of a compound of formula IV.

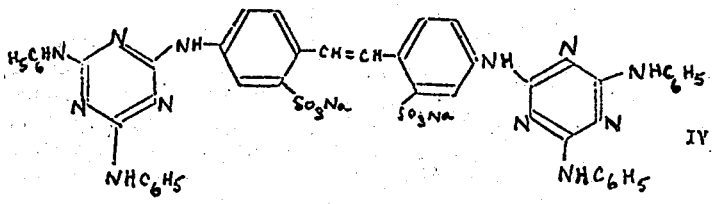

IV

This was first hand-mixed, then homogenised with a Silverson mixer. The Brookfield viscosity range of the slurry was 5,000 centipoises at 6 r.p.m. and 750 centipoises at 60 r.p.m.

Table II lists the settling stability of the slurry over a 12 week period. Examination of this table shows that there was no appreciable settling over the period, and at the end of the period the slurries were stirred and then easily discharged from the container under gravity or by pumping.

Table II

| Slurry settling stability in one ton container. Time elapsed Weeks | SOLIDS CONTENT % Top | Middle | Bottom |
|---|---|---|---|
| 0 | 35.6 | 35.4 | 35.7 |
| 4 | 35.1 | 35.7 | 35.8 |
| 8 | 33.0 | 34.6 | 36.0 |
| 12 | 33.5 | 34.9 | 35.8 |

EXAMPLE 3

1 part of the sodium salt of the condensation product of naphthalene sulphonic acid and formaldehyde, solder the trade mark "Belloid TD", was added to a wet filter-cake comprising 61.6 parts of water, 0.1 parts of sodium chloride and 38.3 parts of a compound of formula II.

60 parts of a 10% solution of sodium chloride in water were added, the whole hand-mixed and then homogenised with a Silverson mixer. 1500 parts of the slurry were then Perl-milled for 2 hours with 1500 parts of Ballotini (3 mm. diameter). After separation of the Ballotini, the viscosity of the slurry was 2600 centipoises at 6 r.p.m. on a Brookfield Viscometer, and the slurry did not settle appreciably over 12 weeks.

Table III

| Slurry settling stability in one ton container. Time elapsed Weeks | SOLIDS CONTENT % Top | Middle | Bottom |
|---|---|---|---|
| 0 | 24.0 | 24.0 | 24.0 |
| 4 | 24.3 | 23.3 | 23.9 |
| 8 | 24.3 | 23.7 | 23.7 |
| 12 | 24.2 | 23.5 | 23.2 |

Perl-milling of the slurry improved the Cold Water Dyeing from 144 units to 257 units (Standard Specification 260 units).

Table III lists the settling stability of the slurry over a 12 week period. At the end of the 12 week period the slurry was stirred and then easily discharged from the container under gravity or by pumping.

This slurry has the same application properties as the normal dry powdered material with regard to low temperature whitening and detergent powder brightener.

EXAMPLE 4

1 part of the sodium salt of the condensation product of naphthalene sulphonic acid and formaldehyde, sold under the trade mark "Belloid TD", was added to a wet filter-cake comprising 75.3 parts of water, 12 parts of sodium chloride, and 23.7 parts of a compound of formula III.

The whole was hand-mixed and then homogenised with a Silverson mixer. The viscosity of the slurry was 2100 centipoises at 6 r.p.m. on a Brookfield Viscometer, and the slurry did not settle appreciably over 12 weeks.

Table IV

| Slurry settling stability in one ton container. Time elapsed Weeks | SOLIDS CONTENT % Top | Middle | Bottom |
|---|---|---|---|
| 0 | 32.2 | 32.2 | 32.2 |
| 4 | 32.0 | 31.4 | 32.0 |
| 8 | 32.0 | 32.2 | 32.6 |
| 12 | 33.2 | 33.9 | 34.0 |

Table IV lists the settling stability of the slurry over a twelve week period. At the end of the twelve week period the slurry was stirred and then easily discharged from the container under gravity or by pumping.

This slurry has the same application properties as the normal dry powdered material with regard to low temperature whitening and detergent powder brightener.

EXAMPLE 5

1 part of the sodium salt of the condensation product of naphthalene sulphonic acid and formaldehyde was added to a wet filter-cake comprising 57 parts of water, 7.7 parts of sodium chloride and 35.3 parts of a compound of formula III.

This was first hand-mixed and then homogenised with a Silverson mixer. The Brookfield viscosity range of the slurry was 5140 centipoises at 6 r.p.m. and 700 centipoises at 60 r.p.m., and settling had not occurred after 73 hours.

EXAMPLES 6 TO 8

The same procedure was carried out as described in Example 5, but with the addition of 0.125, 0.25 and 0.5 parts of highly beneficiated magnesium silicate as gelling agent. The viscosity of the slurries and the settling time is given in Table V.

Table V

| Example | Parts of Gelling Agent | Viscosity Range (6 to 60 r.p.m.) (centipoises) | Slurry did not settle appreciately after |
|---|---|---|---|
| 6 | 0.125 | 5380/730 | 12 weeks |
| 7 | 0.25 | 5520/330 | 12 weeks |
| 8 | 0.5 | 7300/1070 | 12 weeks |

EXAMPLES 9 TO 12

The sodium salt of the condensation product of naphthalene sulphonic acid and formaldehyde was added to a wet filter-cake comprising 63.5 parts water, 0.3 parts of sodium carbonate and 36.2 parts of compound having the formula II.

In Examples 9 and 10 a highly beneficiated magnesium silicate was used as gelling agent, and in Example 12 a specially processed magnesium montmorillonite was used as gelling agent. The slurry was first hand-mixed and then homogenised with a Silverson mixer. The amounts of the additives used and the settling time is given in Table VI.

Table VI

| Example | Parts of dispersing agent | Parts of gelling agent | Slurry did not settle appreciately after |
|---|---|---|---|
| 5 | 0.8 | 0.2 | 12 weeks |
| 6 | 0.8 | 0.5 | 12 weeks |
| 7 | 1.0 | — | 12 weeks |
| 8 | 1.0 | 0.25 | 12 weeks |

These slurries had the same application properties as the normal dry powdered material with regard to whitening at various temperatures and product brightening.

EXAMPLE 13

1 part of the sodium salt of the condensation product of naphthalene sulphonic acid and formaldehyde sold under the Trade Mark "Belloid" TD was added to a wet filter-cake comprising 53.4 parts water, 0.2 parts of a mixture of sodium chloride and 46.4 parts of a compound having the formula V.

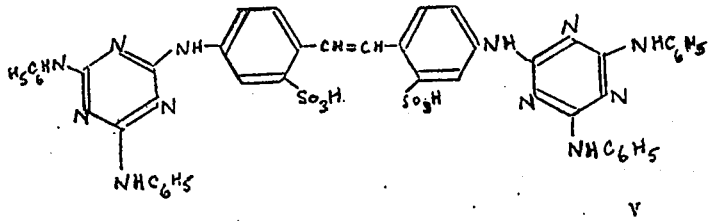

V

This was first hand-mixed and then homogenised with a Silverson mixer. The viscosity range of the slurry was 6900 centipoises at 6 r.p.m. and 971 centipoises at 60 r.p.m. and settling had not occurred after 12 weeks.

When 1 part of the sodium salt of a special sulphonated oil was used instead of the dispersing agent used above, a homogeneous slurry was obtained.

This slurry was the same application properties as the normal dry powdered material with regard to whitening at various temperatures and product brightening.

EXAMPLE 14

0.6 parts of a polymer of mixed propylene/ethylene oxides and 0.5 parts of a highly beneficiated magnesium silicate were added to a wet filter-cake comprising 56.1 parts water, 0.1 parts of sodium chloride and 43.8% of a compound having the formula IV. This was hand-mixed and then homogenised with a Silverson mixer. Settling had not occurred after 12 weeks.

This slurry has the same application properties as the normal dry powdered material with regard to whitening at various temperatures and product brightening.

EXAMPLE 15

2.5 parts of the sodium salt of the condensation product of naphthalene sulphonic acid and formaldehyde sold under the Trade Mark "Belloid" TD were added to 250 parts of a wet filter cake containing 96 parts of the compound having the formula II and to this mixture was added 230 parts by volume of a 10% weight-/volume sodium chloride solution. The mixture was initially mixed by hand and then homogenised with a Silverson mixer. 300 parts of this slurry was then measured into a ball mill which was rotated at 29 revolutions per minute for 24 hours. A white pourable slurry was obtained which did not settle appreciably over a 12 week period, and the cold water dyeing properties were vastly improved when compared with the same product which had not been subjected to a grinding treatment. The cold water dyeing performance was carried out as follows:

There was weighed out accurately on aluminum dishes:

a. 0.0070 grams of a pure compound of formula I 100% standard b. a weight of a slurry of the compound of formula I equivalent to 0.0070 grams of 100% standard product as calculated from the spectrophometric strength.

With the launderometer set at 25°C. the dyebaths were prepared as follows:

The required number of dye-baths were placed in the launderometer tray and 500 milliliters of 4 grams per liter brightener free detergent and a 12.0 gram pattern of bleached immercised cotton sateen were added to each.

These dye-baths were pre-heated to 25°C. and the aluminum dish containing the sample was floated on the liquor and the dye-bath carefully sealed.

All the dye-baths were shaken simultaneously and agitated in the launderometer for exactly 10 minutes. After agitation the dye-baths were removed from the launderometer and the patterns rinsed in cold, running water. Excess water was removed in a spin-dryer.

The patterns were stretched onto pin frames and placed in a drying oven at 70°C. for about 5 minutes, and then removed from the pin frames and allowed to 'condition' to 20°C. and 65% relative humidity for a minimum of two hours.

The patterns were folded in half with the sateen face outward.

Using the Harrison fluorimeter the total fluorescence was measured (given by Filter 2) and the average of five readings taken from each side was recorded.

Batch (a) and batch (b) should have the same cold water dyeing performance. The comparison of the viscosity and cold water dyeing before and after milling is illustrated in Table VII.

TABLE VII

| Sample | Brookfield Viscosity (cps) Measurement (6–60 rpm) | Cold Water Dyeing Batch | Cold Water Dyeing Standard |
|---|---|---|---|
| Before milling | 1080 – 135 | 167 | 262 |
| After milling | 305 – 65 | 260 | 262 |

What we claim is:

1. In a process for preparing an aqueous slurry containing from 15% to 60% by weight, based on the total weight of the slurry, of a compound of the formula

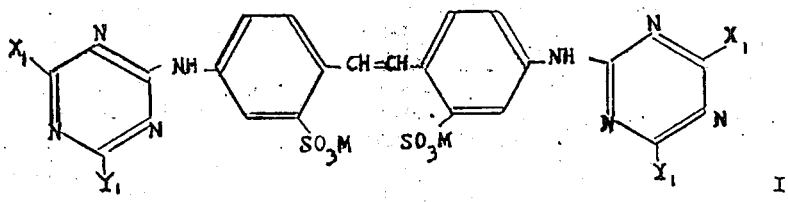

I wherein $X_1$ and $Y_1$ are the same or different and each is phenylamino, phenylamino mono- or di-substituted by alkyl radicals having 1 or 2 carbon atoms, morpholino, alkylamino having 1 to 4 carbon atoms, alkylamino having 1 to 4 carbon atoms substituted by hydroxyl radicals or alkoxy having 1 to 4 carbon atoms, and M is hydrogen or an alkali metal, a major portion of the particles of this compound having size of 5 – 20 microns, which comprises mixing the wet filter cake obtained during the preparation of this compound with an agent to form the slurry, the improvement wherein the agent is from 0.1% to 5% by weight, based on the weight of the wet filter cake, of an anionic, cationic or nonionic surface active agent as dispersing agent, such that the resultant slurry is thixotropic and will not settle out appreciably on static storage and will have a Brookfield viscosity of from 200 to 10,000 centipoises at 6 r.p.m. and up to 2,000 centipoises at 60 r.p.m.

2. A process according to claim 1 in which the slurry contains from 20% to 40% by weight based on the total weight of the slurry of said compound.

3. A process according to claim 1 in which the dispersing agent is the sodium salt of the condensation product of naphthalene sulphonic acid and formaldehyde.

4. A process according to claim 1 in which the amount of dispersing agent is from 0.5 to 2.0% by weight based on the weight of the wet filter cake.

5. A process according to claim 1 wherein the Brookfield Viscosity is from 300 to 5,000 centipoises at 6 r.p.m. and from 50 to 1,000 centipoises at 60 r.p.m.

6. A process according to claim 1 wherein a gelling agent is added to the slurry.

7. A process according to claim 6 wherein the gelling agent is highly beneficiated magnesium silicate.

8. A process according to claim 6 wherein the amount of gelling agent is from 0.1% to 2.0% by weight based on the weight of wet filter-cake.

9. A process according to claim 1, in which there is present in the slurry from 4% to 25% by weight of an electrolyte selected from the group consisting of sodium chloride, sodium sulphate, sodium carbonate, potassium chloride, potassium sulphate and potassium carbonate, based on the total weight of the slurry.

10. A process according to claim 9 wherein the electrolyte is sodium chloride.

11. In a process for preparing an aqueous slurry containing from 15% to 40% by weight, based on the total weight of the slurry, of a compound having the formula

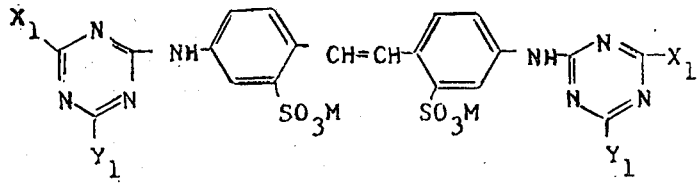

wherein $X_1$ and $Y_1$ are the same or different and each is phenylamino, phenylamino mono- or di-substituted by alkyl radicals having 1 or 2 carbon atoms, morpholino, alkylamino having 1 to 4 carbon atoms, alkylamino having 1 to 4 carbon atoms substituted by hydroxyl radicals or alkoxy having 1 to 4 carbon atoms, and M is hydrogen or an alkali metal, a major portion of the particles of this compound having a size of 5 – 20 microns, which comprises mixing the wet filter cake obtained during the preparation of the compound containing at least 4% by weight of an electrolyte selected from the group consisting of sodium chloride, sodium sulphate, sodium carbonate, potassium chloride, potassium sulphate and potassium carbonate, based on the total weight of the slurry, with an agent to form the slurry and grinding the slurry, the improvement wherein the agent is from 0.1% to 5% by weight, based on the weight of the wet filter cake, of an anionic, cationic or nonionic surface active agent as dispersing agent.

12. A slurry prepared by the process in accordance with claim 11.

13. An aqueous thixotropic slurry characterized by a. a content of from 15% to 60% by weight, based on the total weight of the slurry, of an optical brightener of the formula

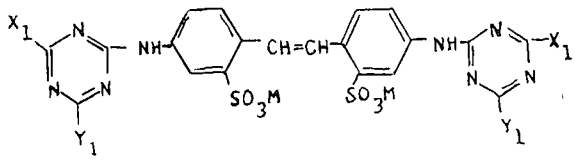

wherein $X_1$ and $Y_1$ are the same or different and each is phenylamino, phenylamino mono- or di-substituted by alkyl radicals having 1 or 2 carbon atoms, morpholino, alkylamino having 1 to 4 carbon atoms, alkylamino having 1 to 4 carbon atoms substituted by hydroxyl radicals or alkoxy having 1 to 4 carbon atoms, and M is hydrogen or an alkali metal, a major portion of the particles of this compound having a size of 5 – 20 microns, b. a content of from 0.1% to 5% by weight, based on the total weight of the wet filter cake obtained during preparation of the optical brightener, of an anionic, cationic or nonionic surface active agent as dispersing agent, which dispersing agent has been mixed directly with the wet filter cake in forming said slurry, and c. a Brookfield viscosity of from 200 to 10,000 centipoises at 6 r.p.m. and up to 2,000 centipoises at 60 r.p.m.

14. A thixotropic slurry according to claim 13 characterized by a content of from 20% to 40% by weight based on the total weight of the slurry of the optical brightener.

15. A thixotropic slurry according to claim 13 in which the dispersing agent is the sodium salt of the condensation product of naphthalene sulphonic acid and formaldehyde.

16. A thixotropic slurry according to claim 13 wherein the Brookfield viscosity is from 300 to 5,000 centipoises at 6 r.p.m. and from 50 to 1,000 centipoises at 60 r.p.m.

17. A thixotropic slurry according to claim 13 characterized by a content of from 0.1% to 2.0% by weight based on the total weight of the slurry of a gelling agent.

18. A thixotropic slurry according to claim 17 wherein the gelling agent is magnesium silicate.

19. An aqueous thixotropic slurry, characterized by a. a content of from 15% to 60% by weight, based on the total weight of the slurry, of an optical brightener of the formula

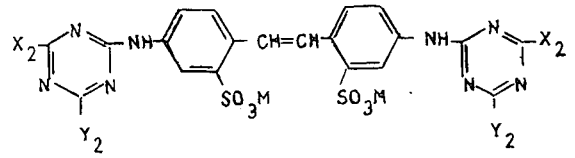

wherein $X_2$ and $Y_2$ are the same or different and each is phenylamino, morpholino, alkylamino having 1 to 4 carbon atoms, or alkylamino having 1 to 4 carbon atoms substituted by hydroxyl radicals, and M is hydrogen or an alkali metal, a major portion of the particles of this compound having a size of 5 – 20 microns, b. a content of from 0.1% to 5 l % by weight, based on the total weight of the wet filter cake obtained during preparation of the optical brightener, of an anionic, cationic or nonionic surface active agent as dispersing agent, which dispersing agent has been mixed directly with the wet filter cake in forming said slurry, and c. a Brookfield viscosity of from 200 to 10,000 centipoises at 6 r.p.m. and up to 2,000 centipoises at 60 r.p.m.

20. An aqueous thixotropic slurry, characterized by a. a content of from 15% to 60% by weight, based on the total weight of the slurry, of an optical brightener of the formula

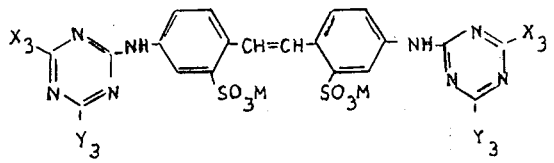

wherein $X_3$ and $Y_3$ are the same or different and each is phenylamino, morpholino or N-methyl-N-ethanolamino, and M is hydrogen or an alkali metal, a major portion of the particles of this compound having a size of 5 – 20 microns, b. a content of from 0.1% to 5% by weight, based on the total weight of the wet filter cake obtained during preparation of the optical brightener, of an anionic, cationic or nonionic surface active agent as dispersing agent, which dispersing agent has been mixed directly with the wet filter cake in forming said slurry, and c. a Brookfield viscosity of from 200 to 10,000 centipoises at 6 r.p.m. and up to 2,000 centipoises at 60 r.p.m.

21. An aqueous thixotropic slurry, characterized by a. a content of from 15% to 60% by weight, based on the total weight of the slurry, of an optical brightener of the formula

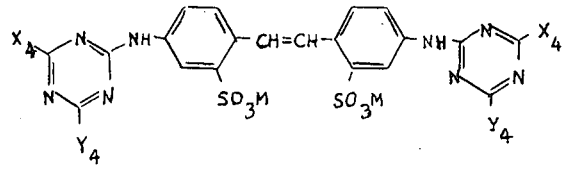

wherein $X_4$ and $Y_4$ are the same or different and each is morpholino or N-methyl-N-ethanolamino, and M is hydrogen or an alkali metal, a major portion of the particles of this compound having a size of 5 – 20 microns, b. a content of from 0.1% to 5% by weight, based on the total weight of the wet filter cake obtained during preparation of the optical brightener, of an anionic, cationic or nonionic surface active agent as dispersing agent, which dispersing agent has been mixed directly with the wet filter cake in forming said slurry, c. a content of from 4% to 25% by weight, based on the total weight of the slurry, of an electrolyte selected from the group consisting of sodium chloride, sodium sulphate, sodium carbonate, potassium chloride, potassium sulphate and potassium carbonate, and d. a Brookfield viscosity of from 200 to 10,000 centipoises at 6 r.p.m. and up to 2,000 centipoises at 60 r.p.m.

22. A thixotropic slurry according to claim 21 wherein the electrolyte is sodium chloride.

23. An aqueous thixotropic slurry, characterized by a. a content of from 15% to 60% by weight, based on the total weight of the slurry, of an optical brightener of the formula

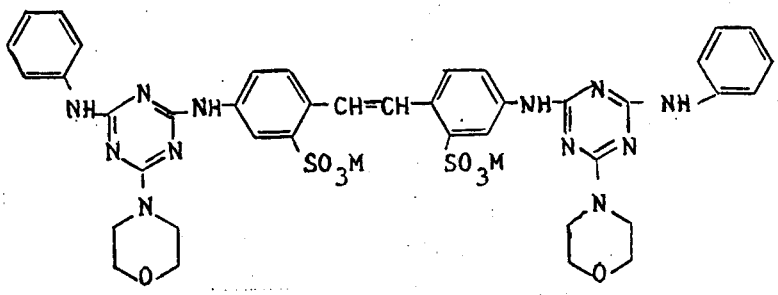

where M is hydrogen or an alkali metal, a maajor portion of the particles of this compound having a size of 5 – 20 microns, b. a content of from 0.1% to 5% by weight, based on the total weight of the wet filter cake obtained during preparation of the optical brightener, of an anionic, cationic or nonionic surface active agent as dispersing agent, which dispersing agent has been mixed directly with the wet filter cake in forming said slurry, c. a content of from 4% to 25% by weight, based on the total weight of the slurry, of an electrolyte selected from the group consisting of sodium chloride, sodium sulphate, sodium carbonate, potassium chloride, potassium sulphate and potassium carbonate, and d. a Brookfield viscosity of from 200 to 10,000 centipoises at 6 r.p.m. and up to 2,000 centipoises at 60 r.p.m.

* * * * *